US007232348B2

(12) United States Patent
Renaudin et al.

(10) Patent No.: US 7,232,348 B2
(45) Date of Patent: Jun. 19, 2007

(54) ELECTRICAL CONNECTION DEVICE FOR BUSHING WHICH SUPPLIES FILAMENTS, SUCH AS GLASS FILAMENTS

(75) Inventors: Jean-Pierre Renaudin, St-Sulpice (FR); Bertrand Flin, La Ravoire (FR); Jean-Louis Thiriet, Chambery (FR); Jean-Francois Vincent, Le Bourget du Lac (FR)

(73) Assignee: Saint-Gobain Vetrotex France S.A., Chambery (FR)

( * ) Notice: Subject to any disclaimer, the term of this patent is extended or adjusted under 35 U.S.C. 154(b) by 14 days.

(21) Appl. No.: 10/543,171

(22) PCT Filed: Jan. 15, 2004

(86) PCT No.: PCT/FR2004/000065

§ 371 (c)(1),
(2), (4) Date: Jul. 22, 2005

(87) PCT Pub. No.: WO2004/079867

PCT Pub. Date: Sep. 16, 2004

(65) Prior Publication Data

US 2006/0148276 A1 Jul. 6, 2006

(30) Foreign Application Priority Data

Jan. 29, 2003 (FR) ..... 03 01165

(51) Int. Cl.
*H01R 4/30* (2006.01)
*H01R 4/38* (2006.01)

(52) U.S. Cl. ..... 439/801; 439/810; 65/496

(58) Field of Classification Search ..... 439/807, 439/799, 797, 858, 1, 801, 810, 213, 784, 439/781, 805, 33; 65/492, 496
See application file for complete search history.

(56) References Cited

U.S. PATENT DOCUMENTS

| | | | | | |
|---|---|---|---|---|---|
| 2,709,795 | A | * | 5/1955 | Williams | 439/807 |
| 3,404,369 | A | * | 10/1968 | Grove | 439/868 |
| 3,969,098 | A | * | 7/1976 | Jensen | 65/488 |
| 4,003,730 | A | * | 1/1977 | Brady et al. | 65/499 |
| 4,394,533 | A | * | 7/1983 | Naito | 174/74 R |
| 4,467,161 | A | * | 8/1984 | Fox et al. | 200/281 |
| 4,846,864 | A | | 7/1989 | Huey | |
| 4,922,068 | A | * | 5/1990 | Bangs | 200/271 |
| 4,973,370 | A | * | 11/1990 | Kreinberg | 156/50 |
| 5,011,421 | A | * | 4/1991 | Duke et al. | 439/213 |
| D400,169 | S | * | 10/1998 | Endo | D13/120 |
| 2006/0057905 | A1 | * | 3/2006 | McGill et al. | 439/886 |

FOREIGN PATENT DOCUMENTS

WO 99/22430 5/1999

* cited by examiner

*Primary Examiner*—Hae Moon Hyeon
(74) *Attorney, Agent, or Firm*—Oblon, Spivak, McClelland, Maier & Neustadt, P.C.

(57) ABSTRACT

An electrical connection device for supplying power to a bushing that delivers filaments, especially glass filaments. The device includes a connection jaw clamp and an electrical connection piece with no protective sheath and including a flexible body, having one end that is connected to the jaw clamp and a free opposite end.

12 Claims, 3 Drawing Sheets

BACKGROUND ART

ELECTRICAL CONNECTION DEVICE FOR BUSHING WHICH SUPPLIES FILAMENTS, SUCH AS GLASS FILAMENTS

FIELD OF THE INVENTION

The invention relates to a fiberizing installation delivering filaments, especially glass filaments, and more particularly to an electrical connection piece via which current is supplied to one of the elements of the fiberizing installation for the purpose of heating it.

BACKGROUND OF THE INVENTION

Conventionally, a fiberizing installation comprises a glass flow block, which receives molten glass coming from a feeder connected to the furnace in which the glass is melted, a bushing block and a bushing. The bushing is fitted at the bottom with a plate provided with a multitude of holes from which the molten glass flows, to be drawn into a multiplicity of filaments.

These filaments, the diameter of which may vary from 5 to 33 μm, are collected into at least one sheet that converges on an assembling device in order to form at least one strand, and, for example, to be wound up. Depending on its use, the strand may also be chopped, (to form chopped strands) or thrown onto a belt (to form continuous strand mats).

The products obtained are used mainly in various reinforcing applications.

The bushing is manufactured from an alloy of platinum and rhodium, which materials are electrically conducting and resistant over time to very high temperatures. This bushing is heated by Joule heating so as to maintain, at a certain temperature, around 1100 to 1400° C., the glass that it contains so that it remains in the molten state, so as to be drawn from the holes in the bottom of the bushing. The bushing is heated using an electrical transformer by the connection of two terminals, each located on each of the opposed sides of the bushing, to electrical connection elements external to the bushing.

The bushing terminals are attached by welding them to the side walls of the bushing. They project so as to be connected to the external connection elements.

These external connection elements are each in the form of a jaw clamp made of electrically conducting material, advantageously copper, which, by means of its two cheeks, clamps a bushing terminal, the jaw clamp being connected to a fixed busbar that is connected to the electrical transformer.

The jaw clamp is therefore a piece that is suspended after the connection terminal of the bushing and mechanically fastened by clamping it using a bolt passing through the cheeks of the jaw clamp.

The connection between the fixed busbar and the jaw clamp is itself provided by simple contact of a portion of the jaw clamp against the busbar, the latter being maintained at the desired height by any appropriate system for fastening onto a fixed element of the surroundings of the bushing, advantageously against the wall of the fiberizing booth.

The improvements made in recent years, such as the increased surface area of the bushing bottom, so as to have more filament-delivering holes, the cooling systems in the bottom of the bushing, and the mechanical reinforcement of the bushing have, on the one hand, created the need to be able to install in succession, in the same fiberizing position, bushings of different lengths and heights, and have, on the other hand, considerably increased the mass of the combination of the bushing and its peripheral equipment. Furthermore, the installing of these bulky bushings and this heavy equipment has made it more difficult for the various members to be accurately adjusted with respect to one another. Finally, the increased surface area of the bushing bottom and the increase in output from the bushing have meant that the electrical power delivered to the bushing in order to heat it has had to be increased. Consequently, the electrical conduction cross section of the jaw clamp had to be increased, which further increased the mass suspended beneath the bushing. The increase in size of these bushings has also resulted in a larger expansion of the bushing bottom, resulting in the generation of mechanical stresses in the terminals, in the bottom and in the actual body of the bushing.

BRIEF SUMMARY OF THE INVENTION

The object of the invention is therefore to provide an electrical connection device that makes it possible, on the one hand, to be fitted to various sizes of bushings and, on the other hand, to lighten the weight and reduce the cost of the equipment supported by the bushing, while still delivering the electrical power needed to heat the bushing.

According to the invention, the electrical connection device intended for supplying power to a bushing that delivers filaments, especially glass filaments, said device comprising a connection jaw clamp, is characterized in that it also comprises an electrical connection piece with no protective sheath and consisting of a flexible body, having one end that is connected to the jaw clamp and a free opposite end.

According to another feature, the flexible body of the connection piece consists of an assembly of strips stacked on top of one another. As a variant, the flexible body of the connection piece consists of a braid.

Advantageously, the connection piece is made of copper and/or aluminum. Preferably, an oxidation-resistant coating covers the connection piece.

According to another feature, the end of the connection piece, connected to the jaw clamp, is fastened to the latter by mechanical retention means, such as welding or bolting.

According to another feature, the end of the connection piece, away from that connected to the jaw clamp, is formed by a rigid connection pad.

The invention also relates to a electrical supply system comprising at least one electrical connection terminal, a current busbar and at least one device according to the invention, which device electrically connects the terminal to the busbar, the connection terminal having a connection portion that co-operates with the connection piece, and the busbar having a contact surface against which the free end of the connection piece is attached.

According to one feature, the connection device is fastened to the connection terminal by bolting the portion to the connection jaw clamp, and the connection device is fastened to the busbar by mutually co-operating fastening means.

These mutually co-operating fastening means consist of projecting elements and of slots into which the projecting elements are intended to fit.

Advantageously, the mutually co-operating fastening means are designed so as to adjust the position of the connection of the free end of the electrical connection piece to the busbar whatever the position of the bushing terminals.

According to another feature, the busbar has a geometry designed so as to bring into contact with its contact surface several free ends of respective connection devices that are connected to a plurality of connection terminals, respectively.

According to another feature, the connection portion of a connection terminal is housed in a groove of the connection jaw clamp, the portion having an opening through which a fastening bolt passes, which opening has a shape designed so as to adjust the position of the fastening.

Finally, this electrical supply system may be used in a fiberizing installation intended to deliver filaments, especially glass filaments, comprising a bushing from which the filaments are drawn, which bushing is heated by at least said electrical supply system.

According to one feature, the terminal or terminals of an electrical supply system are integral with a sidewall of the bushing, whereas the busbar of the electrical supply system is fastened to a wall defining the bushing installation zone.

DETAILED DESCRIPTION OF THE INVENTION

Figure 1:
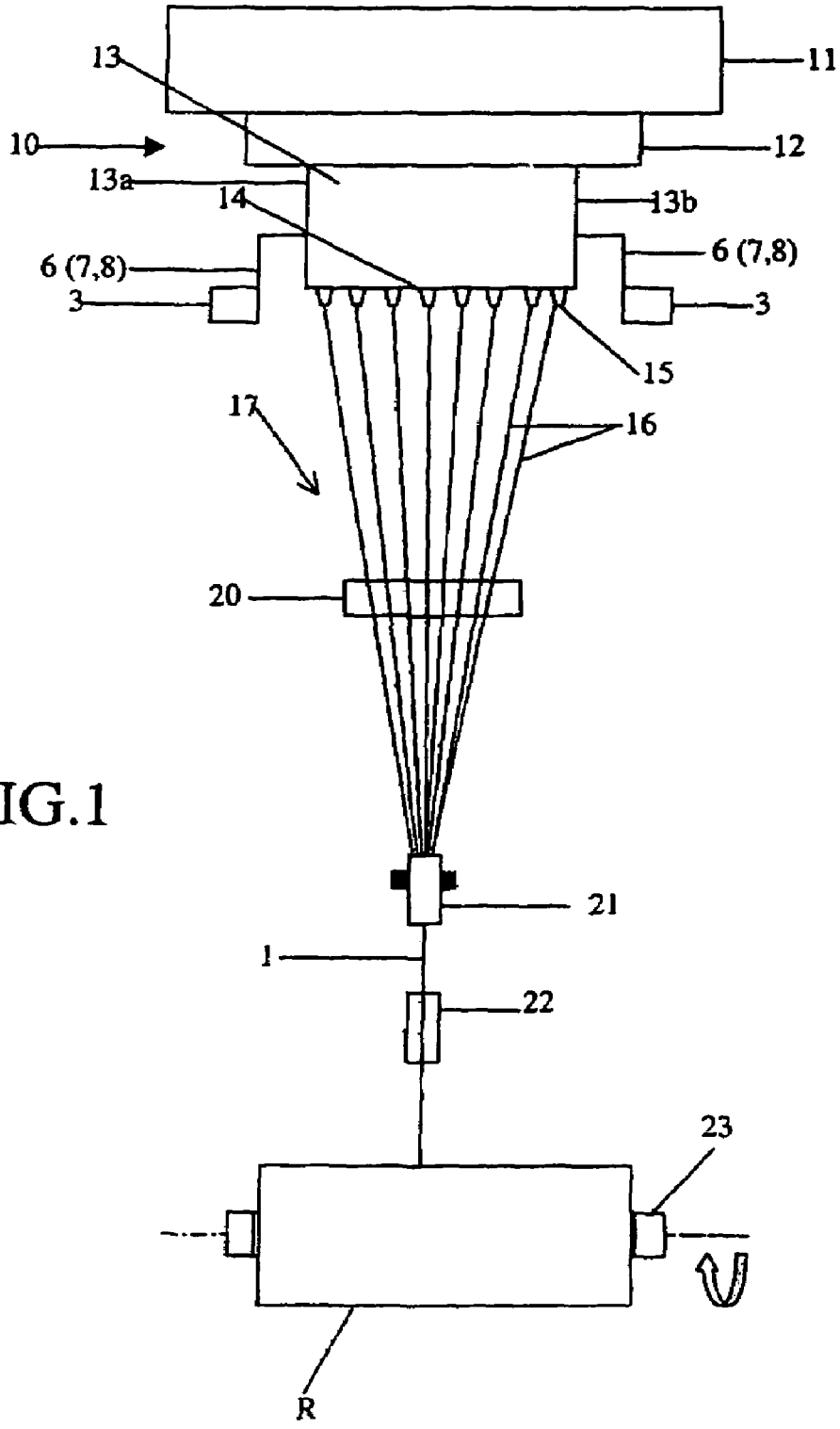
FIG. 1 shows schematically a front view of a bushing associated with the manufacturing product.

FIG. 1 shows schematically a fiberizing installation 10, which conventionally comprises a flow block 11, a bushing block 12 and a bushing 13.

The bushing 13 is fitted at the bottom with a plate 14 which is provided with a multitude of holes 15, drilled into teats, from which the molten glass flows in order to be drawn into a multiplicity of filaments 16. In recent years, the number of holes has approached and even exceeded 4000.

The filaments are collected into a single sheet 17 which comes into contact with a coater 20 intended to coat each filament with a size of aqueous or anhydrous type. The coater 20 may consist of a tank supplied permanently with a sizing composition and of a rotating roll, the lower part of which is permanently immersed in the composition. This roll is permanently covered with a film of size, which is removed as the filaments 16 pass by sliding over its surface.

The sheet 17 then converges onto an assembling device 21 where the various filaments are joined together to create a glass fiber strand 1. The assembling device 21 may be formed by a simple grooved pulley or by a notched plate.

The strand 1 leaving the assembling device 21 enters a strand guide 22 so as to be wound around a support 23 whose axis is horizontal with respect to the vertical entry of the strand into the strand guide. The strand is thus wound, coming directly from the bushing, in order to constitute a roving R.

In order for the molten glass delivered into the bushing 13 to remain at a sufficient melting temperature which is suitable for it to pass through the holes 15 and to be suitably drawn, this bushing is kept heated.

Advantageously, this bushing is made of a platinum-rhodium alloy, which ensures good thermal conductivity, mechanical strength over time at high temperatures, and good electrical conductivity throughout its body and its connection terminals, which are connected to at least one electrical connection device 3.

To optimize the distribution of electrical power delivered to the bushing and to lighten the mass suspended from the bushing, while still delivering sufficient power to heat the bushing, a number of connection terminals, for example three terminals 6, 7, 8 (see FIG. 2), are provided on each side 13*a*, 13*b* of the bushing.

Figure 2:
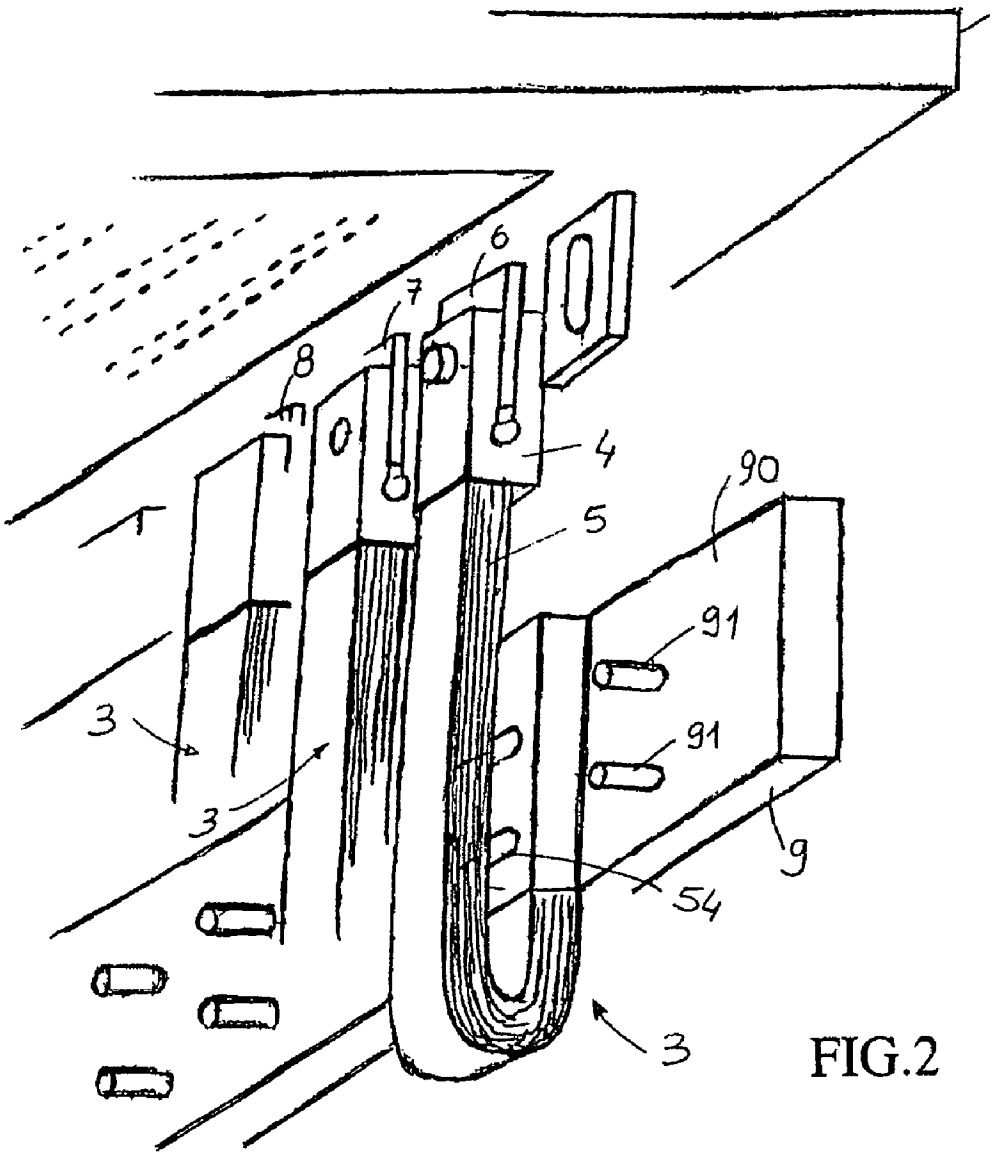
FIG. 2 is a perspective view showing part of the electrical connection of the bushing to an electrical supply via the connection device of the invention.

As illustrated in FIG. 2, each of the terminals 6, 7, 8 on the side 13*a*, and similarly (but not illustrated) on the opposite side 13*b* of the bushing, are connected via an electrical connection device 3 to a fixed busbar 9.

The terminals 6, 7, 8 are made of the same material as the bushing 13 and are welded onto each of the sides 13*a*, 13*b*.

Figure 3:
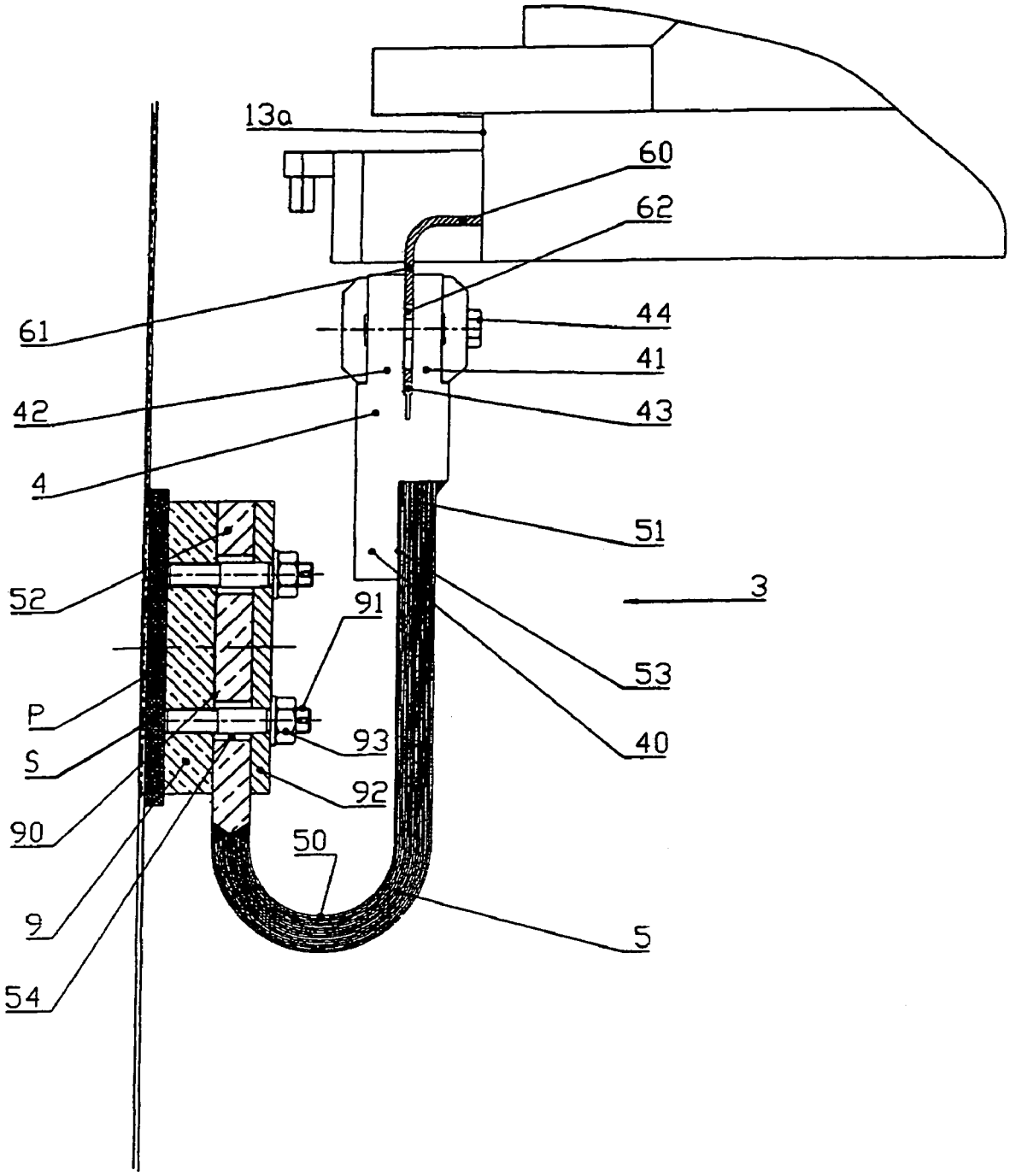
FIG. 3 shows a sectional view of a connection device to which a bushing connection terminal is joined.

Advantageously, a terminal has the shape of an L (see FIG. 3), one flange 60 of which is fastened via its free end to the side 13*a* of the bushing, whereas the other flange 61 of which, perpendicular to the flange 60 and directed parallel to the side of the bushing toward the lower part of the bushing, is connected to a connection device 3. The flange 61 has an opening 62 intended to house, as will be described later, a bolt for fastening the connection device and for adjusting the position or the height of the fastening.

Figure 4:
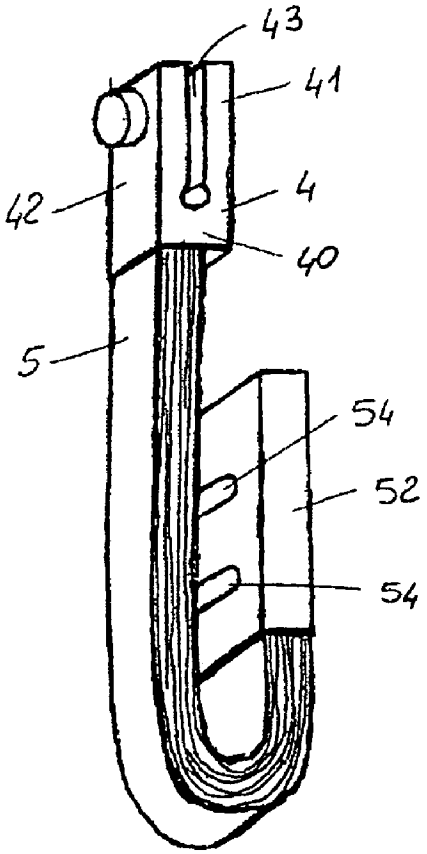
FIG. 4 is a side view of a connection device.

A connection device 3 (see FIGS. 3 and 4) includes a jaw clamp 4 intended to be connected to the connection portion or flange 61 of a bushing terminal, and an electrical connection piece 5 connected via one of its ends 51 to the jaw clamp 4, its opposite end 52 being intended to be connected to the fixed busbar 9.

The jaw clamp 4 has in particular the shape of a U and comprises a central part 40 and two cheeks 41, 42 substantially facing each other and perpendicular to the central part so as to form a groove 43. In the connection position, the flange 61 is housed in the groove 43, and a clamping bolt 44 passing through the cheeks 41, 42 of the jaw clamp and the hole 62 in the terminal forms the mechanical retention of the jaw clamp on the terminal. The dimensions of the hole 62 are sufficient to adjust the height of the fastening, so as to control the length of insertion of the flange 61 into the groove 43 so as to vary the area of contact between the jaw clamp and the terminal, thereby allowing the temperature of the bushing to be adjusted.

The electrical connection piece 5 consists of a flexible U-shaped body 50, which is capable of deforming, and of two opposed ends 51 and 52. The electrical connection piece is made of copper and/or aluminum, preferably entirely copper, and includes no protective sheath.

The flexibility of the body 50 makes it possible to absorb the mechanical stresses generated by the expansion of the bushing when it is being heated, without creating forces that oppose this expansion, especially due to the weight of the equipment supported by the bushing and to the rigidity of the terminals.

The body 50 may consist of an assembly of strips stacked on top of one another, as illustrated, or else of a braid.

The strips have the additional advantage of providing a spring effect tending to raise the end 51 and therefore opposing the vertical forces generated by the weight of the equipment.

The braid has the additional advantage of being able to be twisted on itself, thus giving this type of connection the ability to adapt to any shape and orientation of the bushing terminal.

The end 51, formed like the body 50, is connected to the jaw clamp 4 and is fastened thereto by suitable fastening means 53, such as welding or bolting.

The free end 52 of the connection piece 5 consists of a rigid connection pad that terminates the flexible body 50 to which said pad is fastened, for example by welding.

The connection pad 52 is intended to be connected to the fixed busbar 9. It includes fastening means 54 intended to co-operate mutually with fastening means 91 provided on the busbar 9.

The busbar 9 is a part fastened to the wall P of the fiberizing booth, via an electrically insulating plate S, at a height matched to its position facing the connection devices 3. The busbar 9 is connected to a transformer (not illustrated) and is made of copper in order to produce the best electrical conduction of the current to the connection pad 52, which is connected to it by mechanical contact.

The busbar 9 has a connection face or contact surface 90 against which the connection pad 52 of the flexible connection is pressed.

As mentioned above, it may be preferable to place, on one and the same side of the bushing, several connection terminals, for example three terminals 6, 7, 8. For this reason, the busbar 9 advantageously has the shape of a bar (see FIG. 2) and runs along the length of the side 13*a* of the bushing in order to make it easier to connect the devices 3 to a single element. Thus, whatever the number of connection devices used, which are connected on one side to the single busbar and on the other side to the plurality of bushing terminals, a single piece 9 is needed to connect all the devices 3.

As a variant, several busbars may be provided, each connected to one or more bushing terminals: this makes it possible to supply various zones or various constituent elements of the bushing in a differentiated manner.

The contact surface 90 of the busbar 9 includes fastening means 91 that are intended to mutually co-operate with the fastening means 54 of each of the devices 3. These mutually co-operating means are formed by projecting elements, such as studs, and by slots into which the projecting elements can fit. A clamping plate 92 and additional fastening means 93 of the nut type are joined thereto.

Furthermore, the fastening means are designed to adjust the position of the connection of the connection pad 52 of the electrical connection piece to the busbar 9 relative to the position of the bushing terminals. Thus, whatever the number of bushing terminals, and therefore the number of connection devices 3, it is permitted to fasten the devices to the busbar 9 while adjusting the position of the fastening means 54 or 91 depending on the distance separating two connection pads 52, this distance depending on the number of bushing terminals.

For example, as illustrated, the fastening means 91 of the busbar are formed by projecting elements fixed to the busbar, whereas the means 54 of the connection piece consist of slots passing through the connection pads 52, these slots being advantageously oblong in order to adapt the position of the connection.

As a variant, in order to adapt the position of the connection, the projecting elements may be integral with or fastened to the busbar and capable of being moved and locked in position on the contact surface 90, whereas the means 54 consist of slots of round or oblong shape.

The invention claimed is:

1. An electrical supply system configured to supply power to a bushing that delivers filaments, comprising:

an electrical connection device, comprising a connection jaw clamp;

an electrical connection piece with no protective sheath and including a flexible body, having a first end connected to the jaw clamp and a free opposite end;

at least one electrical connection terminal including a first flange fastened to a side of the bushing and a second flange, which is attached to the first flange and is perpendicular to the first flange; and a current busbar, wherein the connection device electrically connects the connection terminal to the busbar, the connection terminal having a connection portion on the second flange that cooperates with the connection jaw clamp, and the busbar having a contact surface against which the free end of the connection piece is attached.

2. The device as claimed in claim 1, wherein the flexible body of the connection piece includes an assembly of strips stacked on top of one another.

3. The device as claimed in claim 1, wherein the flexible body of the connection piece includes a braid.

4. The device as claimed in claim 1, wherein the connection piece is made of copper and/or aluminum.

5. The device as claimed in claim 1, wherein the first end of the connection piece, connected to the jaw clamp, is fastened to the jaw clamp by a mechanical retention.

6. The device as claimed in claim 1, wherein the free opposite end of the connection piece, away from the first end connected to the jaw clamp, is formed by a rigid connection pad.

7. The electrical supply system as claimed in claim 1, wherein the connection device is fastened to the connection terminal by bolting the connection portion on the second flange to the connection jaw clamp, and the free opposite end of the connection device is fastened to the busbar by a mutually cooperating fastener.

8. The electrical supply system as claimed in claim 7, wherein the mutually cooperating fastener is configured to adjust a position of the connection of the free opposite end of the electrical connection piece to the busbar.

9. The electrical supply system as claimed in claim 1, wherein the busbar has a geometry configured to bring into contact with its contact surface plural free ends of respective connection devices that are connected to a plurality of connection terminals, respectively.

10. The electrical supply system as claimed in claim 1, wherein the connection portion on the second flange of a connection terminal is housed in a groove of the connection jaw clamp, the connection portion having an opening through which a fastening bolt passes, which opening has a shape configured to adjust a position of the fastening bolt.

11. A fiberizing installation configured to deliver filaments, comprising:

a bushing from which the filaments are drawn, which bushing is heated by at least one electrical supply system as claimed in claim 1.

12. The fiberizing installation as claimed in claim 11, wherein a terminal or terminals of an electrical supply system are integral with a sidewall of the bushing, whereas the busbar of the electrical supply system is fastened to a wall defining a bushing installation zone.

* * * * *